US008528900B2

(12) United States Patent
Watanabe et al.

(10) Patent No.: US 8,528,900 B2
(45) Date of Patent: Sep. 10, 2013

(54) SHEET LOADING UNIT AND SHEET HANDLING APPARATUS INCLUDING THE SAME

(75) Inventors: Tetsuo Watanabe, Tokyo (JP); Kazuya Saimei, Kanagawa-ken (JP); Takashi Hirayama, Kanagawa-ken (JP)

(73) Assignee: Toshiba Corporation, Tokyo (JP)

( * ) Notice: Subject to any disclaimer, the term of this patent is extended or adjusted under 35 U.S.C. 154(b) by 0 days.

(21) Appl. No.: 13/408,360

(22) Filed: Feb. 29, 2012

(65) Prior Publication Data

US 2012/0223473 A1 Sep. 6, 2012

(30) Foreign Application Priority Data

Mar. 2, 2011 (JP) ..... 2011-045424

(51) Int. Cl.
*B65H 7/02* (2006.01)

(52) U.S. Cl.
USPC ..... 271/265.02; 271/259; 271/270

(58) Field of Classification Search
USPC ..... 271/258.01, 259, 270, 265.01, 265.02, 271/4.03, 10.03, 2, 31.1, 149
See application file for complete search history.

(56) References Cited

U.S. PATENT DOCUMENTS

| | | | | |
|---|---|---|---|---|
| 4,236,639 | A * | 12/1980 | Boettge et al. | 209/534 |
| 6,588,740 | B2 * | 7/2003 | Brugger et al. | 271/10.03 |
| 7,339,654 | B2 * | 3/2008 | Mizubata et al. | 355/407 |
| 8,066,280 | B2 * | 11/2011 | Simonis et al. | 271/262 |
| 2004/0245698 | A1 * | 12/2004 | Naruoka et al. | 271/10.11 |
| 2010/0044950 | A1 * | 2/2010 | Katsura et al. | 271/10.03 |
| 2011/0006470 | A1 * | 1/2011 | Conaway et al. | 271/34 |

FOREIGN PATENT DOCUMENTS

| | | | |
|---|---|---|---|
| JP | 2003-341860 | A | 12/2003 |
| JP | 2008-280139 | A | 11/2008 |

* cited by examiner

*Primary Examiner* — Jeremy R Severson
(74) *Attorney, Agent, or Firm* — Baker Botts L.L.P.

(57) ABSTRACT

A sheet loading and handling apparatus that suppress anomalies in sheet supply operation and feed sheets in a stable manner is disclosed. The sheet loading unit includes a supply mechanism that moves a plurality of stacked sheets in a direction toward a feeding position located at an end of the loading unit, a feeding mechanism that individually feeds sheets to the feeding position, and a control unit controlling a plurality of sensors, which detect whether there is a sheet at the feeding position. The supply mechanism operates based on detection information of the sensors. The control unit monitors a relationship between signal information of the optical sensor and that of another sensor, and if a signal relationship that is not normal as compared to that of normal feeding occurs, the unit retracts the signal information of the optical sensor and uses only the signal information of the other sensor.

7 Claims, 9 Drawing Sheets

SHEET LOADING UNIT AND SHEET HANDLING APPARATUS INCLUDING THE SAME

CROSS-REFERENCE TO RELATED APPLICATIONS

This application is a continuation of, based upon, and claims the benefit of priority from Japanese Patent Application No. P2011-045424 filed Mar. 2, 2011, the entire contents of which are incorporated herein by reference.

FIELD

Exemplary embodiments described herein relate generally to a sheet loading unit that feeds stacked sheets (or sheet-like articles) such as mail items one by one, and a sheet handling apparatus including such a sheet loading unit.

BACKGROUND

Sheet handling apparatuses such as mail item handling machines that handle mail items such as postcards and letters include, for example, a loading unit, a recognition device (OCR), a stacking device, a rejection stacking device, a switchback device, a conveyance path connecting the devices, gates that distribute conveyed sheets to the respective devices, and so on. A plurality of sheets set in a supply unit of the loading unit are separated and taken out one by one by the loading unit, and conveyed to the recognition device. The recognition device recognizes the sheet, and determines a destination of the sheet (for example, the stacking device or the stacking device) and a conveyance route (for example, whether to cause the sheet to pass through the switchback device so as to be turned over). After that, the sheet is conveyed to the determined device via the conveyance path and a gate mechanism, and various types of processing are performed in that apparatus.

As the loading unit of such a sheet handling apparatus, a type of loading unit that takes out sheets by suction using a negative pressure has been proposed. This loading unit includes an air suction structure that picks up a sheet by suction using a perforated belt and an air chamber, and a separation roller that picks up a second sheet by suction and separates the second sheet from the first sheet so as to prevent the feeding of two sheets at once. The loading unit also includes an optical sensor for detecting whether there is a sheet in the supply unit that supplies sheets or whether the number of sheets in the supply unit is few or many. If the sensor determines that there is no sheet, the supply unit is operated to deliver the next sheet to a feeding position.

Using the sheet loading unit described above, in the case where the sheet has a low light reflectivity (for example, the sheet is black), the optical sensor cannot detect light reflected from the sheet, and thus it is difficult to accurately detect the presence of the sheet. Accordingly, the supply unit pushes the sheet at a speed that is higher than the ideal speed, and the sheets tend to jam in the feeding position. In this case, it may not be possible to feed the front most sheet in a stable manner, or there may be skewing or overlapped feeding of the sheets.

There is a need in the field for a sheet loading unit that can suppress anomalies in the sheet supply operation and feed sheets in a stable manner, and a sheet handling apparatus including such a sheet loading unit. Further, there is a need for a sheet loading unit that can detect sheets that have low light reflectivities.

DETAILED DESCRIPTION

Hereinafter, embodiments of the present disclosure will be described in detail with reference to the drawings.

Figure 1:
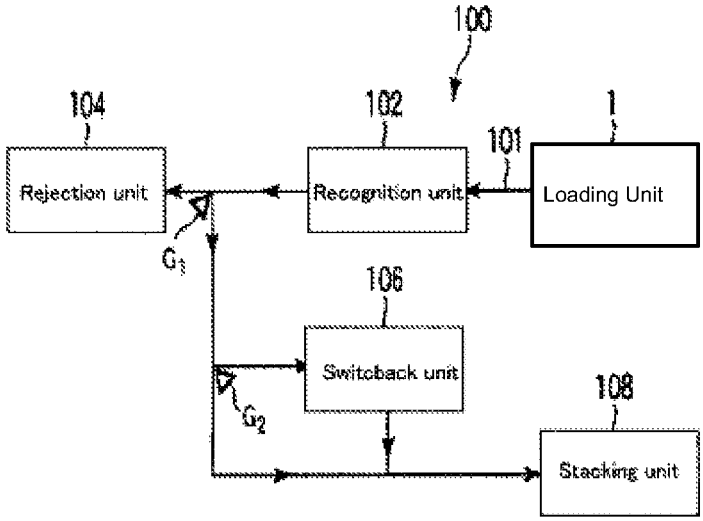
FIG. 1 is a block diagram schematically showing a mail item handling apparatus according to an embodiment of the present disclosure.

FIG. 1 is a block diagram schematically showing a sheet handling apparatus 100 including a sheet loading unit 1 according to an embodiment of the present disclosure. The sheet handling apparatus 100 includes, in addition to the loading unit 1, a recognition unit 102, a rejection unit 104, a switchback unit 106, and a stacking unit 108. The handling apparatus 100 of the present embodiment handles sheets such as mail items, but the types of items that can be handled by the handling apparatus 100 are not limited to mail items.

A plurality of mail items such as postcards and letters are set in the loading unit 1 in a stacked manner and taken out to a conveyance path 101 by the loading unit performing operations as described later. In the conveyance path 101, a plurality of sets of conveyance belts (not shown) are provided so as to sandwich the conveyance path 101. A mail item is sandwiched between the conveyance belts and conveyed.

The mail item taken out to the conveyance path 101 is fed to the recognition unit 102, where a variety of information is read from the mail item. The recognition unit 102 determines information such as the conveyance orientation and sorting destination of the mail item based on the read information. The recognition unit 102 determines the sorting destination by reading address information such as the postal code and address written on the mail item.

After the mail item has passed through the recognition unit 102, the conveyance direction of the mail item is branched by a gate G1. Specifically, a mail item that has been recognized by the recognition unit 102 as a mail item to be rejected is conveyed to the rejection unit 104 via the gate G1, and stacked in the rejection unit. The other mail items are conveyed to the stacking unit 108 via the gate G1 and stacked in the stacking unit 108.

At this time, if the recognition unit 102 determines that the conveyance direction of the mail item needs to be reversed, the mail item is fed to the switchback unit 106 via the gate G1 and a gate G2, and its conveyance direction is reversed by the switchback unit 106. The mail items whose conveyance direction does not need to be reversed are conveyed to the stacking unit 108 while bypassing the switchback unit 106 via the gate G2.

The mail items that have been delivered to the stacking unit 108 via the conveyance path 101 are sorted and stacked in sorter/stacker pockets (not shown) in accordance with the result of determination by the recognition unit 102. The mail items sorted and stacked in each sorter/stacker pocket are stacked such that the leading or trailing edges are aligned.

Figure 2:
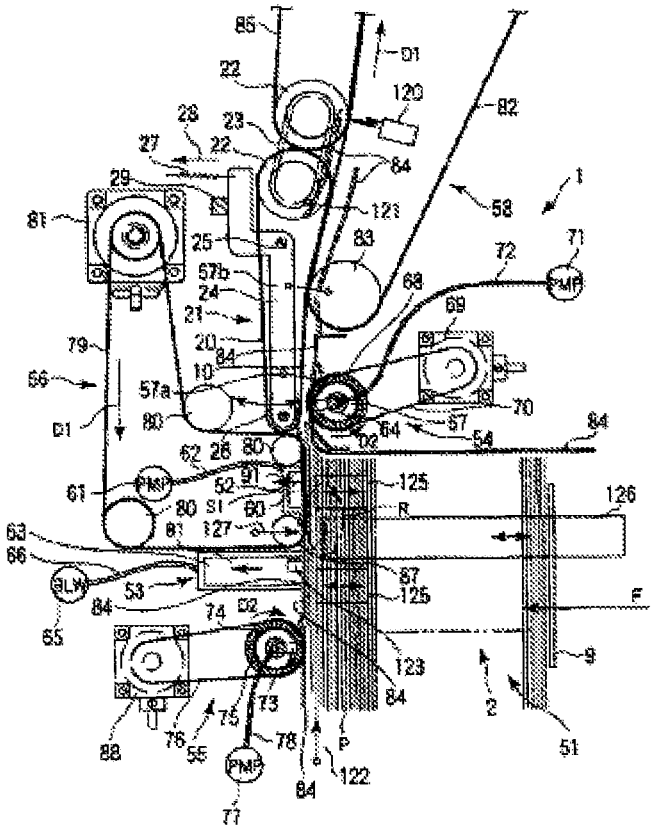
FIG. 2 is a plan view of a loading unit of the sheet handling apparatus.

The sheet loading unit 1 will be described next in detail. FIG. 2 is a plan view of the loading unit 1. The loading unit 1 includes: a loading unit (supply unit) 51 in which a plurality of stacked mail items P are set such that the mail items are substantially vertically upright with respect to the horizontal plane; a supply mechanism 2 that moves the loaded mail items P in the stacking direction so as to supply the frontmost mail item P in the moving direction to a feeding position 87, which will be described later; a feeding mechanism 56 that feeds the mail item P supplied to the feeding position 87 in the surface direction of the mail item P, (or in other words, in a direction substantially perpendicular to the moving direction in this example) such that the mail item P is taken out to a conveyance path 10, which will be described later; a suction mechanism 53 that draws, by suction, the frontmost mail item P of the mail items P loaded into the loading unit 51 toward the feeding position 87; a separation mechanism 54 that separates a second and subsequent mail item P conveyed following the mail item P taken out from the feeding position 87, from the first mail item P; an assistance mechanism 55 that assists the mail item P feeding operation by causing a negative pressure to act on the mail item P supplied to the feeding position 87 on an upstream side of the feeding mechanism 56 and rotating in both forward and reverse directions; and a conveyance mechanism 58 that pulls out the mail item P that has passed through the separation mechanism 54 at a speed slightly higher than a feeding speed and conveys the mail item P toward the downstream side.

The loading unit 1 includes two sensors 57*a* and 57*b* that detect the passage of the mail item P that has been fed from the feeding position 87 located at an end of the loading unit 51 to the conveyance path 10, and a plurality of conveyance guides 84. The sensors 57*a* and 57*b* each include a light emitting portion and a light receiving portion that are provided so as to sandwich the conveyance path 10 through which the mail item P passes, and sequentially detect the passage of the mail item P by the optical axis being blocked by the mail item P. Each conveyance guide 84 guides the movement or conveyance of the mail item P by bringing an edge or surface of the mail item P into contact with the conveyance guide 84.

Figure 3:
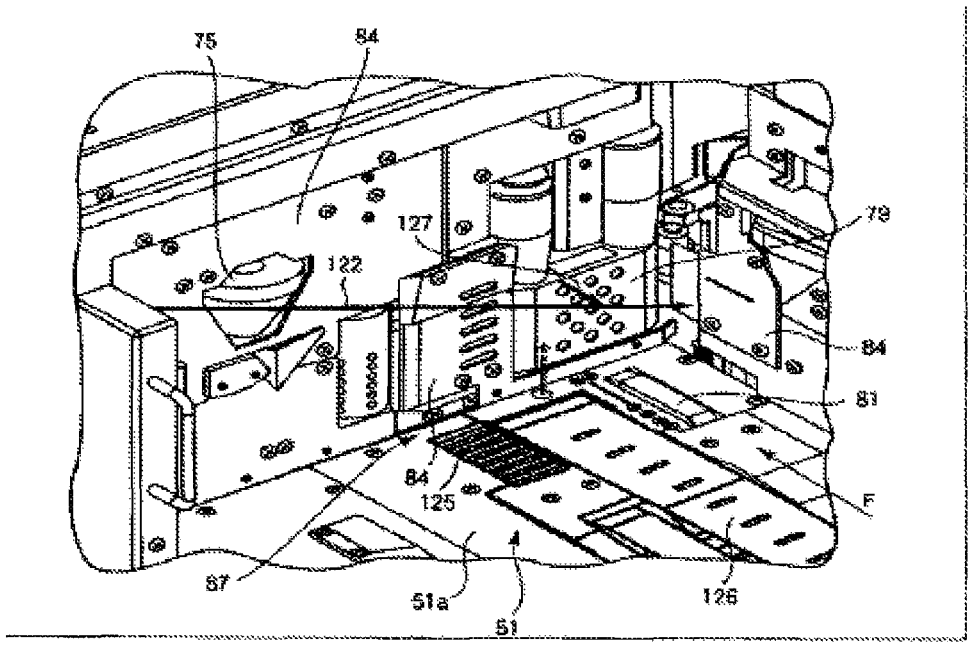
FIG. 3 is a perspective view of a sub-loading unit of the loading unit.

As shown in FIGS. 2 and 3, a plurality of stacked mail items P are placed in the loading unit 51 in an upright manner. In a bottom wall 51*a* of the loading unit 51, a main belt 126 that causes the lower edges of the mail items P to abut the main belt 126 to convey the mail item P in the stacking direction (in the direction indicated by the arrow F in the drawings) and a pair of sub-belts 125 that adjusts the orientation (inclination) of the mail item P are provided, and the belts 126 and 125 are configured to be capable of being driven independently. The main belt 126 extends substantially across the entire length of the loading unit 51 along the conveyance direction F. The sub-belts 125 are provided on both sides of the main belt 126 in the vicinity of the feeding position 87.

A backup plate 9 is disposed at a position that comes into surface contact with the rearmost mail item P in the moving direction of the plurality of mail items P. The backup plate 9 is, for example, simply connected to the main belt 126, and moves in the direction indicated by the arrow F in synchronization with the main belt 126 to press the mail items P in the feeding position direction, and thereby supplies the frontmost mail item P in the moving direction to the feeding position 87. A driving motor 90 drives the main belt, which together with a sub-belt function as the supply mechanism 2.

One of the conveyance guides 84 is provided at a position defining one side of the loading unit 51 along the direction indicated by the arrow F and guides the edge of each mail item P. The other conveyance guides 84 are arranged along the feeding position 87 at an end of the loading unit 51, and function to stop and position the frontmost mail item P in the moving direction that has been supplied in the direction indicated by the arrow F at the feeding position 87, as well as guide the mail item P by coming into contact with one side of the mail item P taken out from the feeding position 87.

As shown in FIG. 2, the feeding mechanism 56 includes a chamber 52, a guide 60 and a vacuum pump 61 (or an equivalent). The vacuum pump 61 is connected with the inside of the chamber 52 via a pipe 62. The feeding mechanism 56 also includes an feeding belt 79 at least a portion of which corresponds to a predetermined region and runs in the direction indicated by the arrow D1 in the drawing (in the feeding direction of the mail item P) along the feeding position 87, and a motor 81 that drives the feeding belt 79. The feeding belt 79 is provided in a tensioned manner by being looped over a plurality of rollers 80 such that at least a part of the feeding belt 79 runs in the direction indicated by the arrow D1 in FIG. 2 along the feeding position 87 and the conveyance path 10 continuously extending from the feeding position 87.

Figure 4:
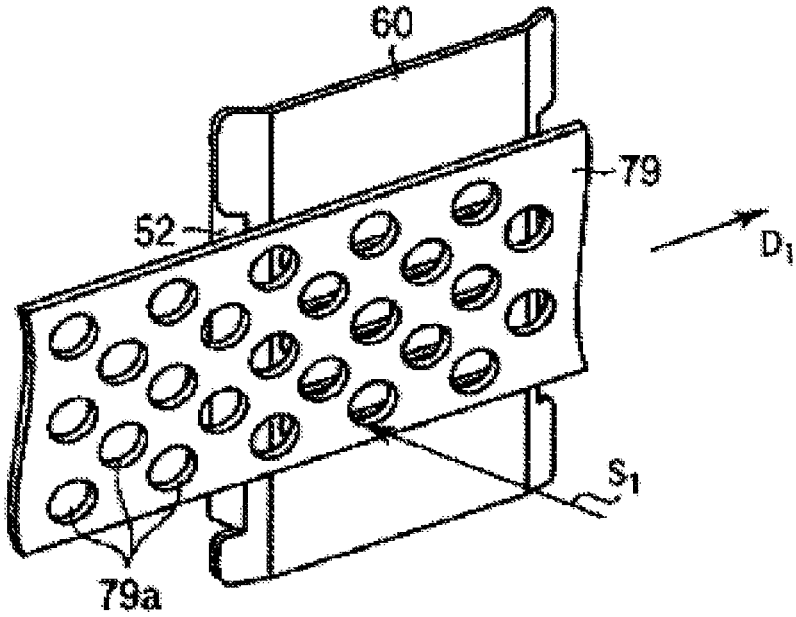
FIG. 4 is a perspective view of a take-out belt and a guide of the loading unit.
Figure 5:
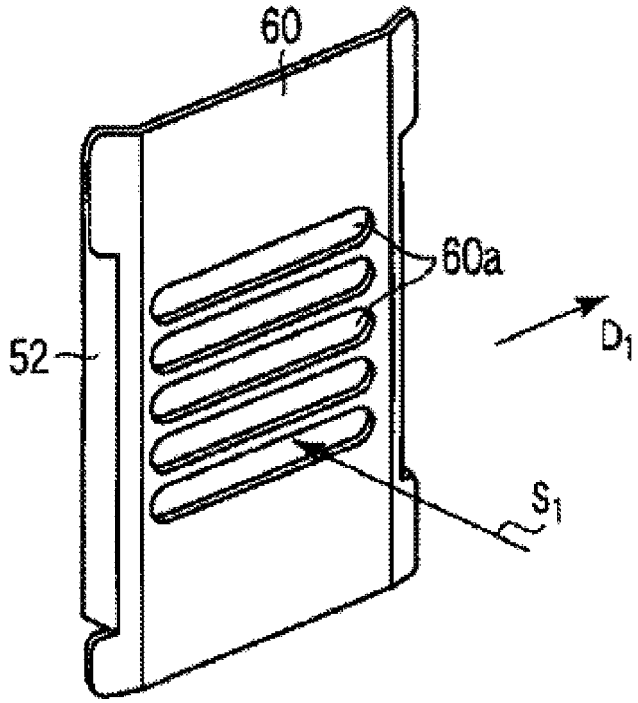
FIG. 5 is a perspective view of the guide.

The guide 60 is disposed at a position opposed to the feeding position 87 inside the feeding belt 79 with the belt interposed between the guide 60 and the feeding portion 87. The chamber 52 is disposed on the back side of the guide 60, specifically, at a position opposed to the feeding position 87 with the feeding belt 79 and the guide 60 interposed between the chamber 52 and the feeding portion 87. As shown in FIG. 4, the feeding belt 79 has many suction holes 79*a*. Also, the guide 60 includes, as shown in FIG. 5, a plurality of elongated slits 60*a* extending along the running direction D1 of the feeding belt 79.

As shown in FIG. 2, when the interior of the chamber 52 is brought into a vacuum by operating the vacuum pump 61, a negative pressure (indicated by the arrow S1 in the figure) acts on the mail item P that has been supplied to the feeding position 87 via an opening (not shown) of the chamber 52 that is opposed to the guide 60, and the mail item P is attached by suction to the surface of the feeding belt 79 and taken out to the conveyance path 10 from the feeding position 87 along with the running of the feeding belt 79.

At this time, the suction force of the vacuum pump 61 is greater than at least the friction force between the first mail item P and the second mail item P. The feeding mechanism 56 feeds the mail items P at the feeding position 87 one by one to the conveyance path 10. However, in the case where a plurality of overlapping mail items P are fed to the conveyance path 10, the overlapping mail items P are separated one by one by the separation mechanism 54, which will be described later.

Figure 6:
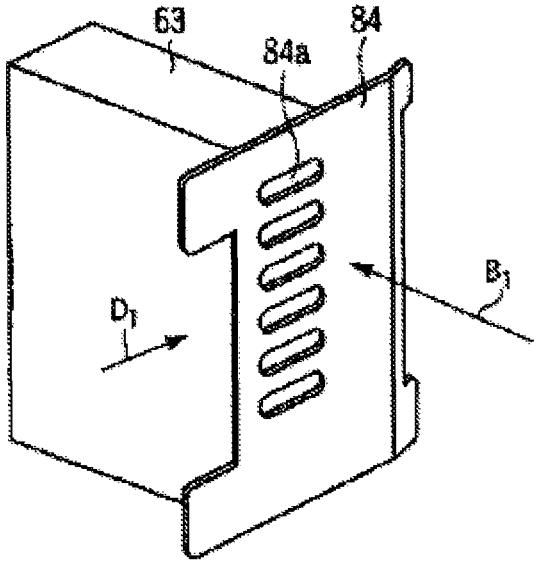
FIG. 6 is a perspective view of a suction mechanism of the loading unit.

The suction mechanism 53 includes a chamber 63 disposed on the back side, with respect to the feeding position 87 and the conveyance guide 84. A blower 65 (or an equivalent) for drawing air into the chamber 63 is connected to the inside of the chamber 63 via a pipe 66. The chamber 63 is disposed adjacent to the feeding position 87, between the feeding mechanism 56 and the assistance mechanism 55, such that its opening (not shown) is opposed to the back surface of the conveyance guide 84. As shown in FIG. 6, the conveyance guide 84 has a plurality of long holes 84*a* having a width that matches the width of the opening of the chamber 63. The long holes 84*a* are disposed within the opening of the chamber 63.

As shown in FIGS. 2 and 6, when the air in the chamber 63 is drawn by operating the blower 65, an air flow is generated in the direction indicated by the arrow B1 in the drawings via the long holes 84*a* of the conveyance guide 84, and the mail item P in the loading unit 51 that is closest to the feeding position 87 is drawn by suction toward the feeding position 87. After the mail item P drawn to the feeding position 87 has been fed toward the feeding position, the next mail item P is drawn by suction toward the feeding position 87. In other words, with the suction mechanism 53, the mail item P that is to be taken out next can be quickly supplied to the feeding position 87. Accordingly, even if the supply force of the supply mechanism 2 in the direction indicated by the arrow F is reduced, at least the first mail item P can be quickly supplied to the feeding position 87 in a constant and stable manner. Consequently, it is possible to speed up the mail item P feeding operation described above, which is performed by the feeding mechanism 56.

As shown in FIG. 2, the separation mechanism 54 is provided opposite to the feeding mechanism 56 and the conveyance path 10 extending toward a downstream side (upward in FIG. 2) of the feeding position 87. The separation mechanism 54 applies a separation torque that acts in the direction opposite to the feeding direction of the mail item P while causing a negative pressure to act on the mail item P, which is conveyed via the conveyance path 10. Specifically, even if the second and subsequent mail items P (there are cases where three or more overlapping mail items P are taken out) are conveyed following the mail item P taken out from the feeding position 87, by operating the separation mechanism 54, the second and subsequent mail items P are stopped or conveyed in the opposite direction by the negative pressure and separation torque described above, and the second and subsequent mail items P are thereby separated from the first mail item P.

More specifically, the separation mechanism 54 includes a separation roller 68 provided along the mail item P feeding direction D1 so as to be capable of rotation in both forward and reverse directions. The separation roller 68 is formed of a substantially cylindrical rigid body made of a metal material or the like. The outer surface of the separation roller 68 is positioned at a position at which it is exposed to the conveyance path 10. The separation roller 68 is attached so as to be capable of rotation about a rotation shaft fixedly attached with respect to the conveyance path 10, and may be rotatable about a cylindrical body 67 including a chamber 64. The separation roller 68 has many suction holes extending therethrough so as to provide communication between its inner surface and outer surface of the separation roller 68. The cylindrical body 67 includes the chamber 64 for generating negative pressure, and it is positioned and fixedly provided such that an opening of the chamber 64 faces the conveyance path 10.

The separation mechanism 54 includes an AC servo motor 69 that rotates the separation roller 68 in both forward and reverse directions at the desired torque, and an endless timing belt 70 for transmitting the driving force generated by the motor 69 to the separation roller 68. The timing belt 70 is provided in a tensioned manner by being looped over a pulley fixed to the rotation shaft of the motor 69 and a pulley (not shown) fixed to the rotation shaft of the separation roller 68. Furthermore, the separation mechanism 54 includes a vacuum pump 71. This vacuum pump is connected to the chamber 64 of the cylindrical body 67 via a pipe 72.

When the interior of the chamber 64 is evacuated by operating the vacuum pump 71, a negative pressure acts on the surface of the mail item P passing through the conveyance path 10 via the opening of the chamber 64 and those suction holes of the separation roller 68 that are opposed to the opening of the chamber, and the mail item P is attached by suction to the outer surface of the separation roller 68. At this time, when the separation roller 68 is rotating, the conveyance force that acts along the rotation direction of the separation roller 68 is also applied to the mail item P attached by suction to the outer surface of the separation roller 68.

Meanwhile, the AC servo motor 69 drives the separation roller 68 such that a predetermined separation torque in the direction D2 opposite to the feeding direction D1 is constantly applied to the separation roller 68. The separation torque is set so that, in the case where one mail item P is conveyed via the conveyance path 10, the separation roller 68 that has drawn by suction the single mail item P can rotate along the feeding direction D1 together with the mail item P, and in the case where a plurality of overlapping mail items P are taken out to the conveyance path 10, the second and subsequent mail items P can be separated from the first mail item P by stopping the second and subsequent mail items P on the separation roller 68 side or conveying them in the opposite direction.

In a state in which one mail item P is properly taken out from the feeding position 87 and conveyed via the conveyance path 10, the conveyance force in the forward direction (in the direction indicated by the arrow D1) applied to the mail item P by the feeding mechanism 56 is larger than the conveyance force in the opposite direction applied to the mail item P by the separation roller 68 to which the separation torque in the opposite direction D2 is applied. Therefore, the mail item P is conveyed in the forward direction D1 while the separation roller 68 rotates in the forward direction D1 together with the mail item P, or stops or rotates in the direction opposite to the feeding direction.

When the separation roller 68 rotates in the opposite direction D2, a possibility arises that if a predetermined separation torque is continuously applied, the rotation speed will gradually increase and adversely affect the feeding of the mail item P. For this reason, in the present embodiment, an upper limit is set to the reverse speed of the separation roller 68. Specifically, an upper limit speed having an absolute value smaller than that of the feeding speed of the mail item P is set.

As shown in FIG. 2, the assistance mechanism 55 disposed below the suction mechanism 53 in the figure, or in other words, on an upstream side of the feeding mechanism 56 along the mail item P feeding direction D1 has substantially the same structure as that of the separation mechanism 54 described above. Specifically, the assistance mechanism 55 has an assistance roller 75 provided along the mail item P feeding direction D1 so as to be capable of rotation in both forward direction and reverse direction D2.

The assistance roller 75 is attached to a rotation shaft fixedly provided in opposed relationship to the feeding position 87, or in other words, to a cylindrical body 74 so as to be capable of rotation, and has many suction holes extending therethrough so as to provide communication between its inner surface and outer surface of the assistance roller 75. The assistance roller 75 is formed of a substantially cylindrical rigid body made of a metal material or its equivalent. The outer surface of the assistance roller 75 is positioned at a position at which it is exposed to the feeding position 87. The cylindrical body 74 includes a chamber 73 for generating negative pressure, and is positioned and fixedly provided such that an opening of the chamber 73 faces the feeding position 87.

The assistance mechanism 55 includes an AC servo motor 88 for rotating the assistance roller 75 in both forward and reverse directions at the desired torque, and an endless timing belt 76 for transmitting the driving force generated by the motor 88 to the assistance roller 75. The assistance mechanism 55 includes a vacuum pump 77 connected, via a pipe 78, to the chamber of the cylindrical body 74 to which the assistance roller 75 is attached so as to be capable of rotation.

The assistance mechanism 55 supports the mail item P feeding operation and the separation operation by rotating the assistance roller 75 in both forward and reverse directions at the desired speed and stopping the assistance roller 75, and turning on or off the negative pressure of the vacuum pump 77.

As shown in FIG. 2, the conveyance mechanism 58 that conveys the mail item P fed by the feeding mechanism 56 to a downstream side includes a plurality of conveyance rollers 22 and 83, a tension roller 26, conveyance belts 20, 82 and 85, and a tension mechanism 21. The conveyance roller 83 is disposed on a downstream side of the separation roller 68, and is adjacent to the conveyance path 10. The conveyance belt 82 is looped over the conveyance roller 83 and another conveyance roller (not shown). The conveyance belt 20 is looped over the tension roller 26 and one of the conveyance rollers 22. The conveyance belt 20 defines the conveyance path 10 together with the conveyance roller 83, and is in contact with the conveyance belt 82.

The tension mechanism 21 includes a tension arm 24 with its center portion being pivotally supported by a pivot 25. The tension roller 26 is pivotally supported at an end of the tension arm 24. A tension spring 27 is provided at the other end of the tension arm 24. The tension arm 24 is thereby biased in a counterclockwise direction about the pivot 25, and is in resilient contact with a stopper 29. The tension roller 26 and the conveyance belt 20 are thereby biased in the conveyance path 10 direction, and the conveyance belt 20, while tension is applied, is in contact with the conveyance belt 82. Furthermore, the conveyance belt 85 is looped over the other conveyance roller 22 and another conveyance roller (not shown). The conveyance belt 85 is in contact with the conveyance belt 82. A driving belt 23 that synchronously rotates the two conveyance rollers 22 is looped over the two conveyance rollers 22. The mail item P is sandwiched between the conveyance belt 82 and the conveyance belts 20 and 85, and is conveyed by these conveyance belts.

Figure 7:
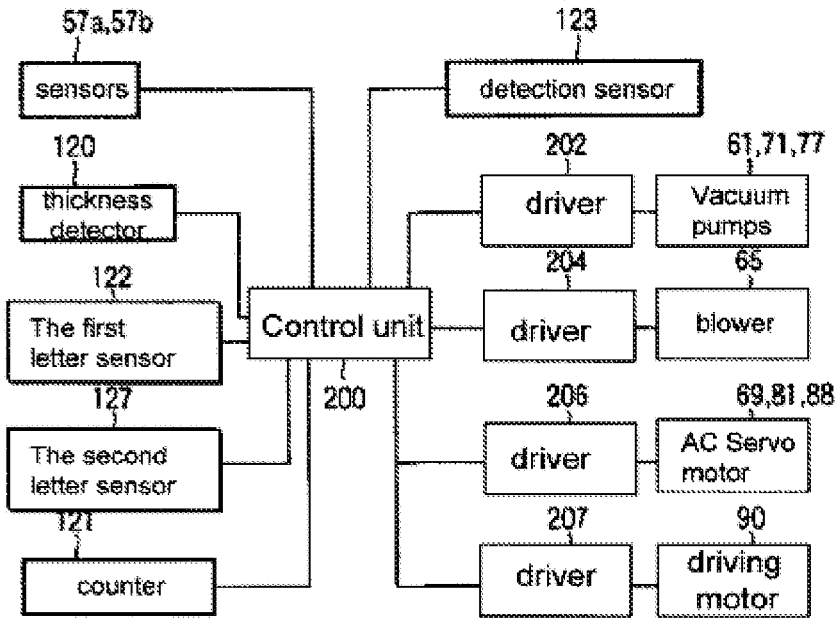
FIG. 7 is a block diagram showing a control unit of the loading unit and various types of sensors.

As shown in FIGS. 2, 3 and 7, the loading unit 1 includes a thickness detector 120 that detects the thickness of the mail item P that has been fed, and a count sensor (counter) 121 that counts the number of mail items P that have been fed. The thickness detector 120 and the count sensor 121 are provided at the conveyance path 10 on a downstream side of the sensors 57*a* and 57*b*. The loading unit 1 also includes, at the feeding position 87 and on a slightly upstream side of the feeding position 87, a plurality of sensors that detect whether there is a mail item P in the loading unit 51 or whether the number of mail items P in the loading unit 51 is few or many, such as a first letter sensor 122, a second letter sensor 127, and a pushing force detection sensor 123 that detects the pushing force of the supply mechanism 2 to push the mail item P, in particular, the pushing force that acts on the frontmost mail item P. The thickness detector 120 may be configured to also function as the count sensor 121.

The sensors 57*a* and 57*b*, the thickness detector 120, the count sensor 121, the first letter sensor 122 and the second letter sensor 127 are connected to a control unit 200 of the loading unit 1, and they send output detection signals to the control unit 200. The control unit 200 is connected to a driver 202 that drives the vacuum pumps 61, 71 and 77, a driver 204 that drives the blower 65, a driver 206 that drives the AC servo motors 69, 81 and 88, and a driver 107 that drives the driving motor 90 of the supply mechanism 2. The control unit 200 drives each driver in response to a detection signal from the sensor.

The pushing force detection sensor 123 can be, for example, a pressure sensor, a sensor that uses a lever and a spring to detect the amount by which the lever is pushed, or the like, and determines how much the mail item P is pushed to the feeding position 87. For example, if it is determined from a detection signal from the pushing force detection sensor 123 that the mail item P is not pushed, or in other words, the detected pushing force is less than a reference value, then the control unit 200 operates the supply mechanism 2 and prompts an operation such as feeding the mail item P forward. If, on the other hand, it is determined that the mail item P is excessively pushed, or in other words, the detected pushing force is higher than a reference value, then the control unit 200 operates the supply mechanism 2 and prompts an operation such as feeding in reverse of the mail item P. The pushing force detection sensor 123 may be a sensor that measures the pushing force itself, or a sensor that only detects the presence of the mail item P.

As shown in FIGS. 2 and 3, the first letter sensor 122 and the second letter sensor 127 are sensors that detect from different directions whether there is a mail item P at the feeding position 87 or on a slightly upstream side of the feeding position 87, and at least one of them is an optical sensor. In the present embodiment, the first letter sensor 122 is a transmissive optical sensor that detects transmitted light, and is provided so as to emit detection light in the surface direction of the stacked mail items P in the vicinity of the feeding position 87 and detect the transmitted detection light. The first letter sensor 122 detects whether there is a mail item P on the optical axis of the first letter sensor 122, or whether the number of mail items P on the optical axis is few or many. For example, if there is a mail item P at the feeding position 87, the detection light from the first letter sensor 122 impinges on an edge of the mail item P and is blocked, and the first letter sensor becomes dark (off). The first letter sensor 122 thereby outputs mail item presence information (dark). If, on the other hand, there is no mail item P at the feeding position 87, the detection light passes through the feeding position and is detected by the first letter sensor 122. The first letter sensor 122 thereby outputs mail item absence information (bright).

The second letter sensor 127 is a reflective optical sensor that detects the light reflected from the mail item P. The second letter sensor 127 is provided, for example, in the vicinity of the front wall of the loading unit 51, and is provided so as to emit detection light toward the mail item P at the feeding position 87 in a direction that intersects with the mail item surface and detect the light reflected feeding position 87, the detection light from the second letter sensor 127 impinges on the surface of the mail item P and is reflected, and the second letter sensor 127 detects the reflected light and becomes bright (on). The second letter sensor 127 thereby outputs mail item presence information (bright). If, on the other hand, there is no mail item P at the feeding position 87, the second letter sensor 127 does not receive reflected light and becomes dark (off). The second letter sensor 127 thereby outputs mail item absence information (dark).

Figure 8:
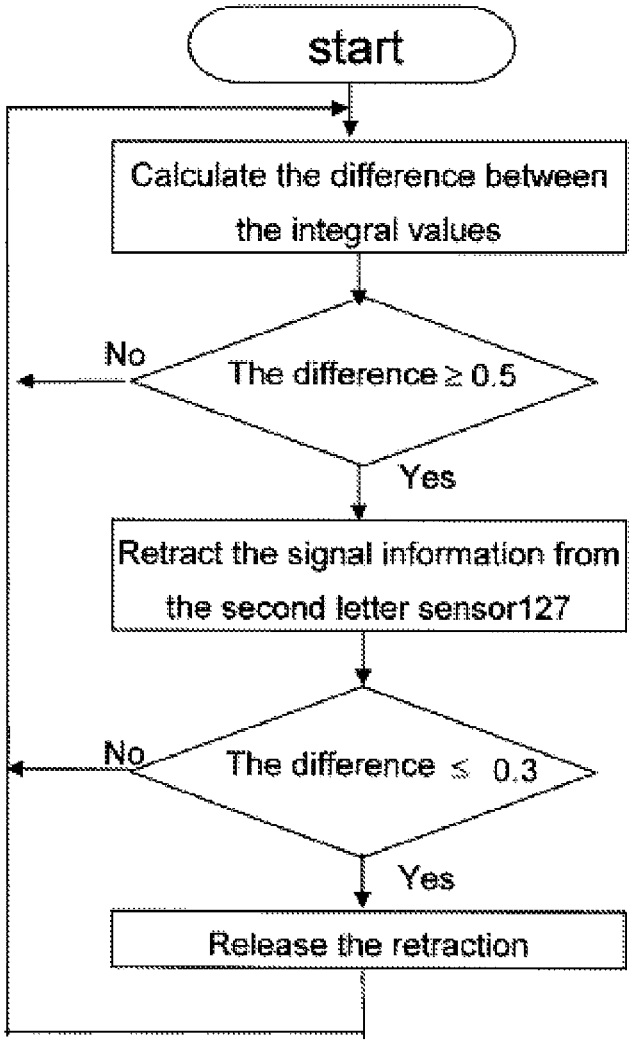
FIG. 8 is a flowchart illustrating mail item supply operations performed by the loading unit.

As shown in FIG. 8, in a normal or regular mode, the control unit 200 controls, using the driving motor 90, the operation of the main belt 126 so as to control the supply speed or feed amount of the mail items P with the supply mechanism 2. If mail item absence information is output from at least one of the first letter sensor 122 and the second letter sensor 127, the control unit 200 executes a feed operation of the supply mechanism 2 to feed the mail items P to the feeding position 87. Specifically, if it is detected that there is no mail item P at the feeding position 87, the control unit 200 determines that there is no or few mail items P and therefore the feeding of the mail item P may become intermittent, and the control unit 200 performs a supply operation. Thereafter, when mail item presence information is signaled from the first letter sensor 122 or the second letter sensor 127, the control unit 200 stops the mail item P supply operation of the supply mechanism 2.

Figure 9:
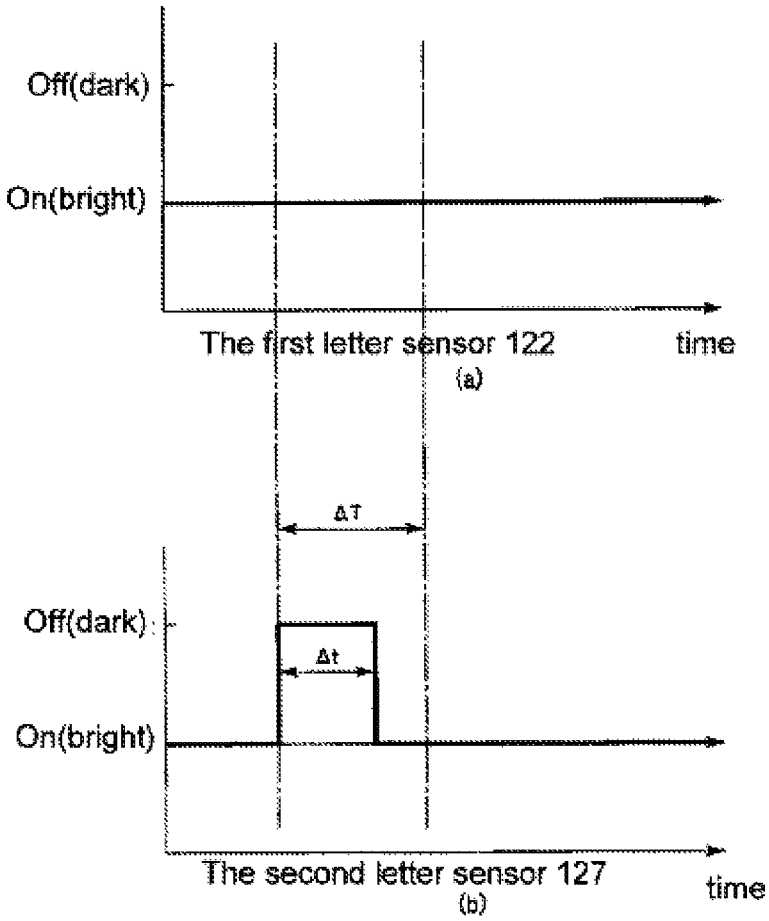
FIGS. 9(*a*) and 9(*b*) are diagrams schematically showing detection signal information of a first letter sensor and a second letter sensor of the loading unit.

The control unit 200 also monitors, during the mail item P feeding operation, the relationship between signal information of the first letter sensor 122 and signal information of the second letter sensor 127. If a signal relationship that is not normal as compared to that of normal feeding occurs, the control unit 200 ignores the signal information of the optical sensor that has been determined as having an anomaly, and continues the supply operation of the supply mechanism 2 based only on the signal information of the other optical sensor. For example, as shown in FIG. 9, the control unit 200 calculates an integral value $\Delta t$ of mail item absence time or mail item presence time for each predetermined period $\Delta T$, for the mail item presence information or the mail item absence information of the first letter sensor 122 and the mail item presence information or the mail item absence information of the second letter sensor 127, and compares the calculated integral values. If the difference between the integral values is greater than or equal to a predetermined value, for example, 0.5 or greater, then the control unit 200 determines that the signal information of one of the sensors is not normal as compared to that of normal feeding.

Usually, in the case where a mail item P is present in the vicinity of the feeding position 87, there is not much difference in the time integral values of the mail item presence signals between the first and second letter sensors 122 and 127. However, for example, if black mail items having a low reflectivity are continuously conveyed, the second letter sensor 127 cannot detect the reflected light so much as it usually does, and thus a difference is likely to occur in the time integral values of the mail item presence signals between the two sensors. For this reason, when the difference between the integral values reaches a predetermined value (for example, 500 msec), the control unit 200 determines that a state that is different from the normal state has occurred, such as, for example, that a black mail item is present at the feeding position 87, and the control unit 200 ignores the signal information from the second letter sensor 127. Specifically, the control unit 200 retracts the signal sent from the second letter sensor 127 and enters an anomaly mode. In the anomaly mode, the supply operation is continued based only on the signal information from the first letter sensor 122 while the second letter sensor 127 is being retracted. In other words, even when the second letter sensor is dark and outputs a mail item absence signal, the supply/pushing operation by the mail item absence signal is ignored.

The control unit 200 continuously calculates the difference between the integral values, and when the difference returns to a predetermined value, for example, 0.3 (300 msec), the control unit 200 releases the retraction of the second letter sensor 127, or in other words, the control unit 200 ends the state in which the second letter sensor is ignored and goes back to the normal mode.

According to the configuration described above, for example, even if sheets having a low light reflectivity such as black mail items are continuously conveyed and a detection anomaly occurs in the optical sensors, by controlling the supply mechanism 2, it is possible to prevent supply operation anomalies such as jamming of mail items in the vicinity of the feeding position. Consequently, the frontmost mail item P can be fed in a stable manner without causing skewing or overlapped feeding.

With the mail item handling apparatus including the loading unit configured as described above, it is possible to suppress anomalies in the sheet supply operation and perform an appropriate sheet supply operation. Consequently, sheets can be taken out in a stable manner, and a sheet handling apparatus with an improved handling speed can be obtained.

The present disclosure is not limited to the embodiments given above, and can be embodied by modifying the constituent elements without departing the spirit of the disclosure when the disclosure is carried out. The present disclosure can be implemented in various forms using appropriate combinations of the constituent elements disclosed in the embodiments given above. For example, some constituent elements may be removed from the constituent elements disclosed in the embodiments. Furthermore, the constituent elements of different embodiments may be combined as appropriate.

The number of sensors that detect the presence of a mail item at the feeding position 87 is not limited to two, and may be three or more. The first and second letter sensors 122 and 127 are not limited to the transmissive optical sensor and the reflective optical sensor, and may be configured using other sensors. Furthermore, the configuration of the second letter sensor 127 is not limited to the configuration in which detection is performed in the direction that intersects with the mail item surface, and the second letter sensor may be disposed, for example, on the bottom wall 51*a* of the loading unit 51, and configured to detect mail items from under the mail items along the mail item surface direction. The sheets used in the present invention are not limited to mail items, and the present invention is applicable to any other types of sheets.

What is claimed is:

1. A method for controlling the supply operation of a sheet handling machine, comprising:

receiving a transmissive light signal through a location at a first sensor;

receiving a reflected light signal from the location at a second sensor;

comparing the relationship of the signal information between the first sensor and the second sensor to a predetermined value to determine an abnormal condition; and if an abnormal condition is detected, ignoring the signal information of the second sensor; and controlling the speed of a supply operation based on the signal information of the first sensor.

2. The method of claim 1, wherein the step of comparing the relationship of the signal information between the first sensor and the second sensor to a predetermined value comprises:

calculating an integral value of sheet presence time for a predetermined period for each sensor.

3. The method of claim 1, further comprising detecting whether there is a sheet on an optical axis of the first sensor and detecting whether the number of sheets on the optical axis of the first sensor is few or many.

4. The method of claim 1, further comprising:

detecting a pressure exerted on the sheet at a force detection sensor;

comparing the pressure to a reference value; and controlling the speed of the supply operation based on the comparison.

5. The method of claim 1, further comprising:

if light is received at the first sensor, stopping the supply operation; and executing a feed operation.

6. The method of claim 1, further comprising:

if no light is received at the second sensor, stopping the supply operation; and executing a feed operation.

7. The method of claim 1, wherein the first sensor is operable to detect a sheet with low light reflectivity.

* * * * *